United States Patent [19]

Umezu

[11] Patent Number: 4,703,508

[45] Date of Patent: Oct. 27, 1987

[54] LOUDSPEAKER TERMINAL STRIP

[75] Inventor: Mitsuo Umezu, Fort Lee, N.J.

[73] Assignee: Sony Corporation, Tokyo, Japan

[21] Appl. No.: 854,929

[22] Filed: Apr. 23, 1986

[51] Int. Cl.[4] ..... H04R 1/02; H04R 1/06; H01R 13/72

[52] U.S. Cl. ..... 381/188; 381/205; 439/550; 439/559

[58] Field of Search ..... 179/178, 186; 339/126 R, 126 RS, 126 J, 128; 381/188, 205

[56] References Cited

U.S. PATENT DOCUMENTS

| | | | |
|---|---|---|---|
| 2,215,366 | 9/1940 | Alden | 339/126 R |
| 2,291,808 | 8/1942 | Henning | 339/126 R |
| 2,352,126 | 6/1944 | Schmitt | 339/126 R |
| 3,091,795 | 6/1963 | Budwig | 339/128 |
| 3,292,132 | 12/1966 | Murphy | 339/126 R |
| 3,706,957 | 12/1972 | Iantorno | 339/126 R |
| 3,838,380 | 9/1974 | Stieler | 339/126 R |
| 4,314,220 | 2/1982 | Ito et al. | 339/126 R |
| 4,329,006 | 5/1982 | Gale | 339/126 R |
| 4,504,108 | 3/1985 | Fiumefreddo et al. | 339/126 R |

FOREIGN PATENT DOCUMENTS

| | | | |
|---|---|---|---|
| 741729 | 11/1943 | Fed. Rep. of Germany | 339/126 R |
| 2244879 | 3/1974 | Fed. Rep. of Germany | 339/126 R |
| 52-16690 | 2/1977 | Japan | 339/126 R |

*Primary Examiner*—Gene Z. Rubinson
*Assistant Examiner*—Danita R. Byrad
*Attorney, Agent, or Firm*—Lewis H. Eslinger; Alvin Sinderbrand

[57] ABSTRACT

A loudspeaker terminal strip has a generally cup-shaped, semi-cylindrical, extending portion that is press-fit into a hole formed in the wall of a speaker cabinet. The semi-cylindrical extending portion has a flat longitudinal plane formed on the cup-shaped semi-cylindrical portion that extends beyond the extension of the cup-shaped semi-cylindrical portion and acts as a flat guide wall during assembly to align the terminal strip in the hole, both radially and axially. The hole in the cabinet wall is also formed as a partial circle with a chord that corresponds in width to the width of the flat guide wall and which initially engages the flat guide wall during insertion of the terminal strip into the hole.

15 Claims, 16 Drawing Figures

LOUDSPEAKER TERMINAL STRIP

BACKGROUND OF THE INVENTION

1. Field of the Invention

This invention relates generally to a terminal strip for use in electrically connecting a loudspeaker to an amplifier and, more particularly, to a loudspeaker terminal strip that is adapted to be mounted in the wall of a speaker cabinet or housing by a press fitting technique.

2. Description of the Background

With the advent of component stereo systems that utilize separate, individually arranged loudspeakers has come the requirement to easily make the necessary electrical connection between the remotely located loudspeakers and the amplifier or receiver. Such connections are generally made to special terminals arranged in the rear or side wall of the loudspeaker cabinet, and these terminals must be sealed relative to such wall, because in most loudspeakers the integrity of the speaker enclosure is important.

Thus, it is known to provide a loudspeaker terminal strip generally formed as a cup-shaped, plastic housing that fits in a corresponding aperture that is cut into the rear wall of the speaker cabinet. Generally, such loudspeaker terminals are push-button type terminals that can be actuated by finger pressure, in which the speaker wire is inserted into an aperture that is opened by such finger pressure, with the pressure then released to make the necessary electrical contact. Screw-type or five-way binding posts may alternately be employed in the same cup-shaped plastic housing. One way of attaching the terminal strip to the speaker cabinet, once the aperture has been formed therein, is simply to use wood screws to attach the loudspeaker terminal strip to the wooden speaker cabinet. Another way of attaching the terminal strip that has become increasingly popular is to make the diameter of the hole formed in the loudspeaker cabinet rear wall approximately the same as the outside diameter of the cup-shaped terminal strip, so that the two may be press fit together without requiring separate fasteners. While this approach has eliminated some assembly steps, it has also presented problems, because in order to obtain a proper press fit, the axial alignment of the cup-shaped loudspeaker terminal strip and the hole formed in the cabinet is required to be quite accurate, so that binding does not occur. Additionally, although generally one portion of the loudspeaker terminal strip is round or cup-shaped, it has a square rim or flange and the radial alignment of the entire terminal strip is critical from an esthetics viewpoint, thereby calling for additional set-up fixtures during the assembly process.

OBJECTS AND SUMMARY OF THE INVENTION

Accordingly, it is an object of the present invention to provide a loudspeaker terminal strip that can eliminate the above-noted defects inherent in the prior art.

Another object of this invention is to provide a cup-shaped loudspeaker terminal strip that is intended to be press fit into a hole formed in a wall of a loudspeaker cabinet and is provided with a flattened guide wall that is formed as a planar chord of the cylinder of the cup-shaped speaker terminal strip.

A further object of this invention is to provide a loudspeaker terminal strip that has a substantially cylindrical cup-shaped portion that extends into a hole formed in a wall of the cabinet and that has a guide wall formed as a chord of such cylinder, with the guide wall extending beyond the extension of the cylindrical cup-shaped portion.

In accordance with an aspect of the present invention, a loudspeaker terminal strip is provided having a generally cylindrical cup-shaped extension that is intended to be press fit into a suitable hole formed in the loudspeaker cabinet wall, however, a portion of the cylindrical wall is replaced by a chordal plane that forms a guide wall. The complementary hole formed in the rear wall of the speaker cabinet is also formed, not as a circle, but as a partial circle having a corresponding chord. This guide wall of the inventive terminal strip extends in the axial direction beyond the extension of the cup-shaped portion and is used for aligning the terminal strip during the press fit assembly operation. In addition, by providing the guide wall as a planar chord of the cylindrical extension of the cup-shaped terminal strip, the hole formed in the loudspeaker cabinet need not be completely round and, thus, has a circumference less than a circle, which aids in prolonging cutting tool life.

The above and other objects, features, and advantages of the present invention will become apparent from the following detailed description of illustrated embodiments thereof to be read in conjunction with the accompanying drawings, in which like reference numerals represent like or similar elements.

DETAILED DESCRIPTION OF PREFERRED EMBODIMENTS

Figure 1:
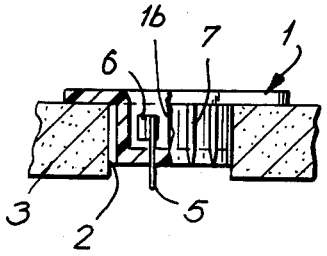
FIG. 1 PRIOR ART
FIG. 1 is a side elevational view, in partial cross section, of a loudspeaker terminal strip known in the prior art.

FIG. 1 shows in partial cross-section the results of a technique known for use in attaching a cup-shaped terminal strip to a wall of a speaker cabinet, without requiring additional fasteners, such as screws, nails, or the like. More particularly, a terminal strip 1 is intended to be press fit into a hole 2 formed in a wall 3 of a wooden speaker housing, which is typically formed of a wood composition, such as particle board, in order to eliminate resonance in the speaker cabinet. This terminal strip 1 is generally cup-shaped with a cylindrical portion 1*a* extending into hole 2 formed in the wall 3 and with a hollow, open, cup-shaped portion 1*b* in which is arranged the actual push-button terminals 6 for connecting the speaker wires. Such terminal strips also generally have two protruding tabs 5 extending into the interior of the speaker cabinet for connection to the loudspeaker or to a cross-over network. This terminal strip construction is shown in more detail in FIGS. 3A–3E.

Terminal strip 1 is intended to be press fit into aperture 2 formed in loudspeaker wall 3, and in one known technique the two diameters are not made identical but the cylindrical portion 1*a* is made less in diameter than the hole 2 and a number of longitudinally extending ribs or projections 7 are formed around the circumference of the cylindrical extension 1*a* of the cup-shaped terminal strip 1. This type of prior art loudspeaker terminal strip having the cylindrical cup-shaped portion 1*a* is quite well known and is the kind of terminal strip used in many commercial loudspeakers.

Figure 2:
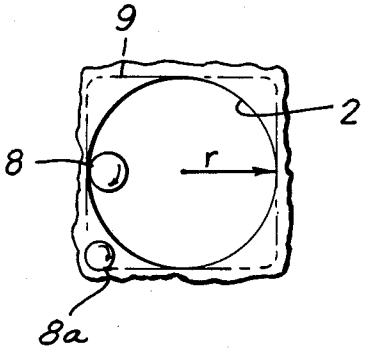
FIG. 2 is a diagrammatic illustration of the operations required to form the hole in the speaker cabinet represented in FIG. 1.

FIG. 2 is a diagrammatic representation of the operations involved in forming the hole 2 in the speaker cabinet wall 3. More particularly, such holes are round in shape and are generally made with a side-cutting rotor drill driven by an automatic machine tool. This production operation is similar to using a home router. Such rotor drill is represented at 8 in FIG. 2 as having a clock-wise rotation, which would then be driven appropriately by the drive machine to form the desired hole. Assuming that hole 2 that is to be formed in speaker wall 3 has a radius r, then the rotor drill 8 must move a total distance of $2\pi r$. The advantages of using a round hole are quickly seen when compared with a square hole of the same general size, shown in dashed lines 9 in FIG. 2, because the total circumference of square hole 9 is approximately equal 8r ($4\times 2r$). Thus, it can be seen that, assuming a constant cutting speed for the square-hole rotor drill 8*a*, the time needed to form the round hole 2 would be approximately 20% less than the time required to form the square hole 9. Moreover, because rotor drills 8, 8*a* have a fixed life span in use, 20% of the processing costs for exchanging drill bits can be realized by utilizing a round hole. In addition, utilizing a round hole permits the press fitting installation to provide uniform pressure between the circumference of the extending terminal strip portion 1*a* and the inner wall, as opposed to a square aperture in which the pressures would not be uniform therearound.

Figure 3A:
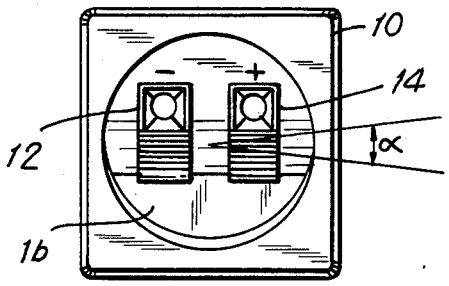
FIG. 3A PRIOR ART
FIGS. 3A–3E are elevational views showing a loudspeaker terminal known in the prior art.
Figure 3B:
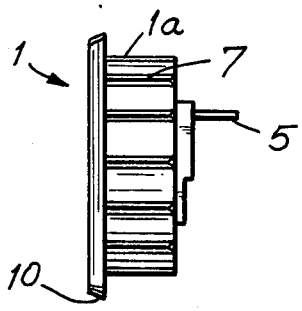
FIG. 3B PRIOR ART
Figure 3C:
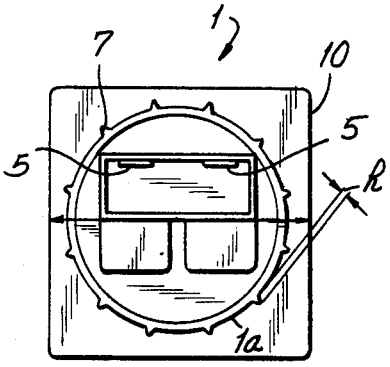
FIG. 3C PRIOR ART

FIGS. 3A–3C are elevational views of cup-shaped terminal strip 1 having the cylindrical extension 1*a* known in the prior art and that is adapted to be press fit into a hole formed in a wall of a loudspeaker cabinet. More particularly, a square outer flange 10 is typically provided that is mounted flush against the outer surface of the speaker cabinet, with the cylindrical portion 1*a* extending into the interior of the cabinet. Two push button terminals 12 and 14 are provided and are indicated as negative and positive, respectively, so that the phasing of the two stereo loudspeakers can be correlated. Because the cup-shaped terminal strip 1 is generally round, it is necessary to properly align the square flange 10 in order to present a professional appearance, and it is seen at angle $\alpha$ that there is only a slight tolerance for rotating the terminal 1 in its mounting position without appearing unacceptably twisted. Generally, an L-shaped ruler or square is required to measure the correct angle from a reference point for angle $\alpha$, this additional measuring step results in increasing the assembly time. Moreover, it is easily possible to place the entire terminal strip 1 upside down, that is, to rotate the terminal strip by 180° from its correct orientation.

FIG. 3B is a side elevational view of the same prior art terminal strip 1, in which the electrical connection tabs 5 are seen, as are the axial ribs or projections 7 formed on the cylindrical extending portion 1*a*.

FIG. 3C is a rear elevational view of prior art terminal strip 1, in which the exact arrangement of the plurality of ribs around the cylindrical extending portion 1*a* can be seen and in which the height of each individual rib 7 is represented typically at h. In other words, the diameter of the circular hole to be formed in the speaker cabinet wall would be the same as the diameter of cylindrical extending portion 1*a*, without the ribs 7.

Figure 3D:
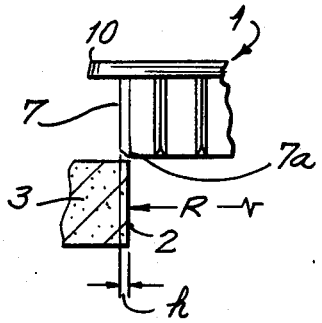
FIG. 3D PRIOR ART
Figure 3E:
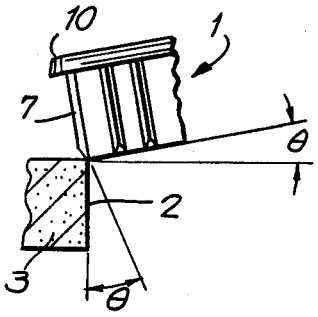
FIG. 3E PRIOR ART
Figure 4A:
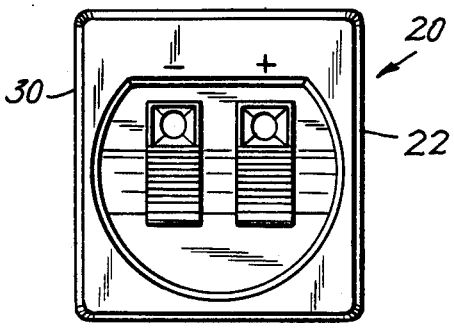
FIGS. 4A–4D are elevational views showing a loudspeaker terminal strip according to an embodiment of the present invention.
Figure 4B:
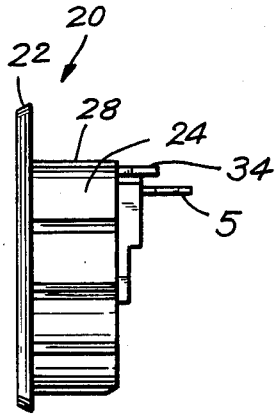
Figure 4C:
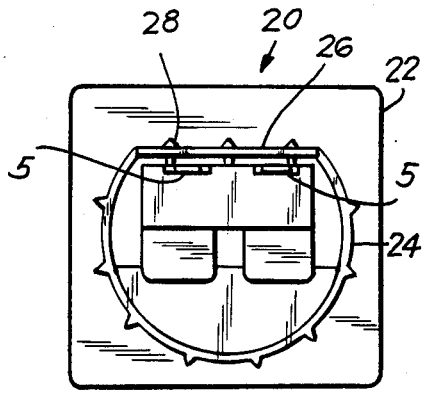
Figure 4D:
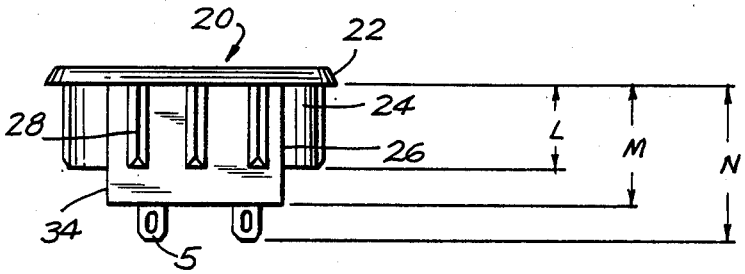

FIGS. 3D and 3E show the problems that occur with the prior art terminal strips relative to the difficulties present during the press-fit assembly operation of terminal strip 1, shown in detail in FIGS. 3A–3C. Because the hole 2 in the mounting board 3 has a diameter r that is about the same as that of the cylindrical portion 1*a*, the plurality of ribs or projections 7, each of height h, prevents the easy insertion of the terminal strip 1 into the aperture 2 during the set up stage, as represented in FIG. 3D. Generally, the leading edge of each of the ribs 7 is provided with a tapered portion 7*a*. in order to make the press fit operation easier, however, this unwittingly works as a disadvantage because it then becomes much easier to misalign the terminal strip 1 in the hole 2 during the set-up procedure, as represented in FIG. 3E. Such misalignment corresponds to an angle $\theta$, which is generally indicated as the angle of the tapered portion 7*a* of the ribs 7 on the cylindrical extending portion 1*a*.

Thus, it is a purpose of the invention to eliminate the above-described problem in setting up the terminal strip prior to the press-fit operation and also to eliminate the requirement for an additional tool, such as an L-shaped square or the like, to make certain that the terminal strip is aligned properly in the hole cut in the rear wall of the speaker cabinet.

FIGS. 4A–4D are elevational views showing a loudspeaker terminal strip 20 according to the present invention in which a square flange 22 is provided, however, a part of the cylindrical extending portion of the prior art terminal strip is eliminated. This cylindrical portion (1*a* in FIGS. 3A–3E) is replaced by an extending portion 24 having a flat, longitudinally extending guide wall 26. The location of flat guide wall 26 corresponds to the straight line portion 30 seen in FIG. 4A. Flat guide wall 26 is also provided with ribs or protrusions 28 for use during the press fit operation. The same ribs 28 that are on the flat guide wall 26 are also on the partially cylindrical portion 24. The flat guide wall 26 has a further extension portion 34 that is provided without any ribs or projections and is substantially a plane surface that extends beyond the extending portion 24. Preferably, the extension M of the flat guide wall 26 is greater than the depth L of the partial cylindrical portion 24, both of which are less than the extension N of the terminals 5.

Figure 5:
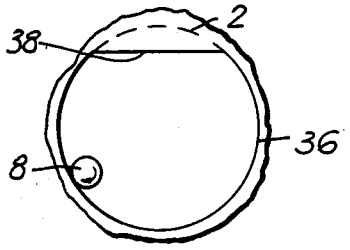
FIG. 5 is a diagrammatic representation of the operations necessary to form the hole in the speaker cabinet for mounting the loudspeaker terminal strip of FIGS. 4A–4D.

FIG. 5 represents the mounting hole 36 or aperture now required by the inventive terminal strip 20, as compared with the hole 2, shown by the dashed line, formed in the operation described above in relation to FIG. 2. Accordingly, it is seen in FIG. 5 that the hole 36 is modified according to the present invention such that, when the rotor drill 8 is again operated to form the hole, a complete circle is not formed but, rather, a chord 38 is formed, thereby resulting in a cutting operation that takes less time than the operation needed to cut a full circle 2. This results not only in time savings during construction but, also, reduces costs by extending tool bit life, as described above.

Figure 6A:
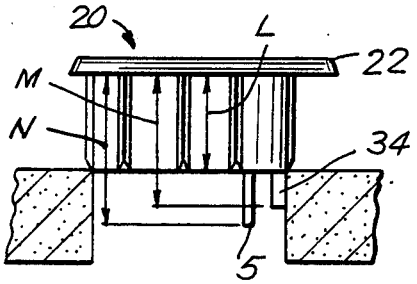
FIGS. 6A–6C are diagrammatic illustrations of the mounting operation of the loudspeaker terminal strip shown in 4A–4D.
Figure 6B:
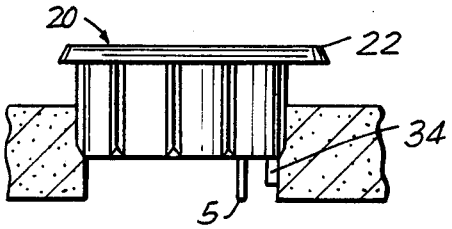
Figure 6C:
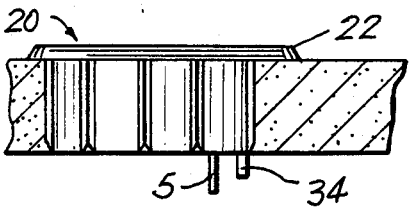

Turning then to FIGS. 6A–6C, an actual press fit operation involving the above-described embodiment according to the present invention is shown in more detail. In FIG. 6A, it can be seen that in setting up the inventive terminal strip 20 prior to the press-fit operation, the front surface 34 of the flat guide wall 26 may be butted up against the straight edge 38 that is part of the hole 36 cut in the board 3, thereby properly aligning the terminal strip 20 relative to angle $\alpha$, as seen in FIG. 3A, and also in regard to angle $\theta$, as seen in FIG. 3E. Thus, it is a simple matter of aligning the flat planar surface 34 having no ribs with the straight wall 38 of the hole 34. As clearly seen in FIG. 6B, there is no possibility that the terminal strip 20 can change its orientation and, thus, is at all times properly aligned.

In addition, as discussed above in relation to FIG. 4D, the length or height L of the partial cylindrical extending portion 24 relative to the length M of the flat guide wall 26 is such that the guide wall is made longer by a predetermined length, and this is particularly provided to maintain a parallel relationship between the terminal strip 20 and the cabinet wall 3 and, indeed, a larger margin of depth $(M-L)$ is advantageous, however, a relationship in which $L<M<N$ is necessary only if the terminal lug would be located too close to the inner wall of the cabinet and the additional length is needed in order to wire the unit in the housing.

Figure 7:
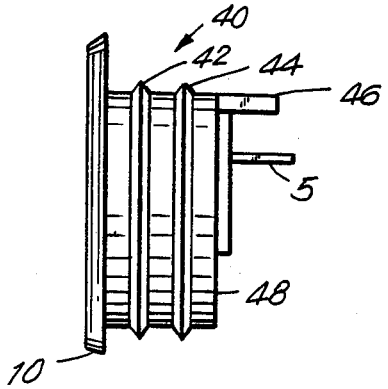
FIG. 7 is side elevational view of a loudspeaker terminal strip according to another embodiment of the present invention.

FIG. 7 represents a further embodiment of the present invention in which a terminal strip 40 has radial ribs 42, 44 in place of the axially extending ribs that were arranged parallel to the direction of insertion of the terminal strip. These ribs 42, 44 form continuous, circumferential projections extending over the straight guide wall portion 46 and the partially cylindrical portion 48 and serve to provide the necessary locking function in the press fit assembly operation. The other elements of the terminal strip 40, such as the flat guide wall construction, are the same as the embodiment of FIGS. 4A–4D.

The above description is provided for a single preferred embodiment of the invention, however, it will be apparent that many modifications and variations could be effected by one skilled in the art without departing from the spirit or scope of the novel concepts of the invention, which should be determined only by the appended claims.

What is claimed is:

1. A loudspeaker terminal strip for mounting in a hole in a cabinet wall for facilitating an electrical connection between at least two electrical conductors, comprising:

terminal element means having a first and second electrical connection means for use in making an electrical connection between two electrical conductors;

a housing for mounting said terminal element means, said housing including:

a flat flange element for abutting said cabinet wall;

a hollow cup-shaped portion extending a predetermined length from said flange element and having said terminal element means arranged therein with said first and second electrical connection means respectively arranged inside and outside an end wall of said hollow cup-shaped portion, said cup-shaped portion being adapted for insertion into said hole, and said housing further including a flat extension element that extends beyond said predetermined length of said cup-shaped portion and being adapted for initial insertion into and engagement with said hole, whereby said extension element initially engages a side wall of said hole ahead of said cup-shaped portion during said mounting in said cabinet wall and extends into said hole in the cabinet wall with said end wall of said hollow cup-board portion following said mounting.

2. A loudspeaker terminal strip according to claim 1, in which said hollow cup-shaped portion is a semi-cylindrical element and said extending element is a flat guide wall longitudinally arranged on said semi-cylinder and extending therebeyond.

3. A loudspeaker terminal strip according to claim 2, in which said connection means arranged outside of said end wall has a length that extends beyond said flat guide wall.

4. A loudspeaker terminal strip according to claim 2, in which said flat guide wall has longitudinal protrusions formed thereon that extend above the surface of said flat guide wall to engage an inner surface in said hole.

5. A loudspeaker terminal strip according to claim 4, in which said longitudinal protrusions on said flat guide wall extend for a length less than a length of said guide wall and commence adjacent said flange element.

6. A loudspeaker terminal strip according to claim 5, in which said longitudinal protrusions comprise ribs.

7. A loudspeaker terminal strip according to claim 2, further comprising circumferential protruding rings formed around said semi-cylindrical element and said flat guide wall to engage in inner surface in said hole.

8. A loudspeaker terminal strip according to claim 2, in which said hollow cup-shaped portion in which said terminal element means is arranged includes means for indicating the orientation of said flat guide wall relative to said semi-cylindrical element.

9. A loudspeaker terminal strip of the kinds for mounting in a hole in a speaker cabinet wall for making a connection between two electrical conductors, comprising:

a plastic cup-shaped housing;

a pair of terminal elements each having a first and second connector for attaching respective electrical conductors, said housing including a flange element for abutting said cabinet wall, and a semi-cylindrical portion having a predetermined extension for insertion into said hole, and said housing further including a flat guide wall arranged on said semi-cylindrical portion that extends beyond said predetermined extension of said semi-cylindrical portion in a direction of said insertion for initially engaging a wall of said hold during said mounting in said speaker cabinet wall, whereby said flat guide wall and said semi-cylindrical portion extend into said hole in said speaker cabinet.

10. A loudspeaker terminal strip according to claim 9, in which said one of said first and second connectors have a length that extends beyond said flat guide wall.

11. A loudspeaker terminal strip according to claim 10, in which said flat guide wall has longitudinal protrusions formed thereon that extend above the surface of said flat guide wall to engage an inner surface in said hole.

12. A loudspeaker terminal strip according to claim 11, in which said longitudinal protrusions on said flat guide wall extend for a length less than a length of said flat guide wall and extend from said flange element.

13. A loudspeaker terminal strip according to claim 12, in which said longitudinal protrusion comprise ribs.

14. A loudspeaker terminal strip according to claim 10, further comprising at least two circumferential protruding rings formed around said semi-cylindrical portion and said flat guide wall to engage in inner surface in said hole.

15. A loudspeaker terminal strip according to claim 10, in which said plastic cup-shaped housing includes means for indicating the orientation of said flat guide wall relative to said semi-cylindrical portion.

* * * * *